United States Patent [19]

Bowser

[11] 3,999,470

[45] Dec. 28, 1976

[54] FLAP SETTER

[75] Inventor: Robert E. Bowser, Elmira, N.Y.

[73] Assignee: Simplimatic Engineering Co., Lynchburg, Va.

[22] Filed: May 14, 1975

[21] Appl. No.: 577,393

[52] U.S. Cl. ..... 93/52; 53/387

[51] Int. Cl.[2] ..... B31B 1/36

[58] Field of Search ..... 93/36.3, 46, 50, 52; 53/387

[56] References Cited

UNITED STATES PATENTS

| | | | |
|---|---|---|---|
| 1,463,627 | 7/1923 | Milmoe | 53/387 X |
| 2,068,439 | 1/1937 | Staves | 53/387 |
| 2,135,806 | 11/1938 | Freemann et al. | 53/387 X |
| 2,390,120 | 12/1945 | Peters | 93/52 |
| 2,808,693 | 10/1957 | Guggenheim | 53/387 X |
| 2,974,460 | 3/1961 | Walther | 53/387 X |
| 2,987,973 | 6/1961 | Chandler | 93/52 |
| 3,208,195 | 9/1965 | Rodman | 53/387 |
| 3,398,660 | 8/1968 | Watrous | 93/52 X |
| 3,564,981 | 2/1971 | Von Arland | 93/52 X |
| 3,884,131 | 5/1975 | Palsson | 93/52 X |

*Primary Examiner*—Travis S. McGehee
*Assistant Examiner*—J. Sipos

[57] ABSTRACT

The apparatus includes a frame and means for moving a container relative to the frame. A series of force exerting rollers are adjustably mounted on the frame and engagable with the container such that they are effective to exert a force on the crease line of the flap as the container is moved relative to the frame. In this manner, the crease is manipulated or worked such that the flap will remain in the closed position. Rollers are also provided for preventing deformation of the container surface adjacent the crease line as the force exerting rollers act thereon. Some of the force exerting rollers have a surface oriented at 45° from the top of the container and thus act directly on the crease line. The deformation preventing rollers have a surface parallel to the surface of the container adjacent thereto. A force exerting roller may be combined with a deformation preventing roller to form a single roller having a flanged portion and a cylindrical portion. In addition, the rollers may be positioned along the path of movement of the container successively closer to the surface upon which the container is moved such that each exerts a progressively greater force on the container as it is moved.

12 Claims, 7 Drawing Figures

3
3
A
B
C
D
12
16
18
20
22
32
34
34
36
40
44
56
58
60
64
68
70
72
74
80
82
87
87
88
88
89
89
98
100
104
106
108
110
112
114
118
122
126
134
154
156
158
162
174

FLAP SETTER

The present invention relates to container handling apparatus and more particularly to apparatus for setting a container flap in a given position relative to the container.

Prior to shipment or storage in a warehouse facility, containers such as cartons or boxes are often arranged, stacked and/or palletized after the contents thereof, for example, bottles, have been placed therein and the carton closed. In certain situations, the cartons are unsealed during or before such operations. Closed but unsealed cartons, however, create difficulties on automated container arranging, stacking and/or palletizing systems because the flaps thereof, even though previously closed, tend to partially open thereby interfering with the arranging, stacking and/or palletizing operation and/or the various sensing and safety functions of the apparatus involved.

Moreover, since an automatic container handling system represents a substantial capital investment, it is desirable, when an addition component or station is to be added thereto, that this new component or station be designed such that it can be readily associated with the pre-existing components of the line. Further, it is desirable to have the additional component mobile, thereby permitting use of same on different lines or different positions in the same line at different times. Therefore, the component must be compatible with the pre-existing carton transport system, not interfere with other operations on the line and at the same time not require any additional floor space which may be unavailable due to the design of the already existing automated system.

It is, therefore, a prime object of the present invention to provide a flap setter which acts on the flaps of a closed but unsealed container to prevent the subsequent movement thereof from the closed position.

It is a second object of the present invention to provide a flap setter which utilizes means engagable with the container closely adjacent the flap crease line to work the crease such that the flap remains in the closed position.

It is a third object of the present invention to provide a flap setter capable of acting on containers while the containers are being conveyed on a conventional conveyor system without interfering with the system.

It is a fourth object of the present invention to provide a flap setter which does not require any additional floor space over that required by the conveyor system.

It is another object of the present invention to provide a flap setter which can be readily associated with pre-existing conveyor systems.

It is a further object of the present invention to provide a flap setter with container surface deformation preventing means such that the force exerted on the crease line works the crease instead of temporarily deforming the container.

It is still another object of the present invention to provide a flap setter wherein the crease working rollers may be situated to exert progressively increased forces on the container as the container is moved.

It is still a further object of the present invention to provide a flap setter wherein the rollers are adjustable relative to a frame to permit different size containers to be accommodated by the apparatus.

In accordance with the present invention, apparatus is provided for setting a container flap, formed along a crease line, in a given position relative to the container. The apparatus includes a frame and means for moving the container relative to the frame. Means mounted on the frame are engagable with the container and are effective to exert a force on the crease line as the container is moved relative to the frame. These means work or manipulate the crease such that the flap remains in the given position. In order to assure that the force exerted by the force exerting means works or manipulates the crease without temporarily deforming the container surfaces adjacent the crease, a means for preventing deformation of the container surfaces is provided for use in conjunction with some of the force exerting means. The deformation preventing means acts on a portion of the container surface adjacent the point on the crease line upon which the force exerting means acts.

The force exerting means comprises, in part, a roller which is oriented to have a surface which is approximately 45° from the top surface of the container and thus contacts the crease line directly. The deformation preventing means comprises a roller having a surface which is substantially parallel to the surface of the container which it contacts. These functions may be combined by utilizing a single roller comprised of a flanged portion and a cylindrical portion.

The rollers are mounted on a support which, in turn, is mounted on a frame relative to which the container is moved. The support is adjustably mounted on the frame to accommodate various size cartons. In addition, the support may be inclined slightly in the direction of movement of the container such that successive rollers are closer and closer to the surface upon which the container is transported. In this manner, the crease is worked or manipulated by progressively increasing forces as the container passes through the frame.

The flap setter is designed for use in conjunction with a pre-existing conveyor system. The frame is structured such that the apparatus can be readily associated with a portion of the conveyor by mounting same in a position above the conveyor such that the apparatus acts upon the containers as they are moved by the conveyor, without interfering with same. Further, because the apparatus can be utilized above a portion of a pre-existing conveyor system, no additional floor space is requred.

To these and other objects as may hereinafter appear, the present invention relates to a flap setter as defined in the appended claims and as described in the specification taken together with the drawings wherein like numerals refer to like parts and in which:

Figure 1:
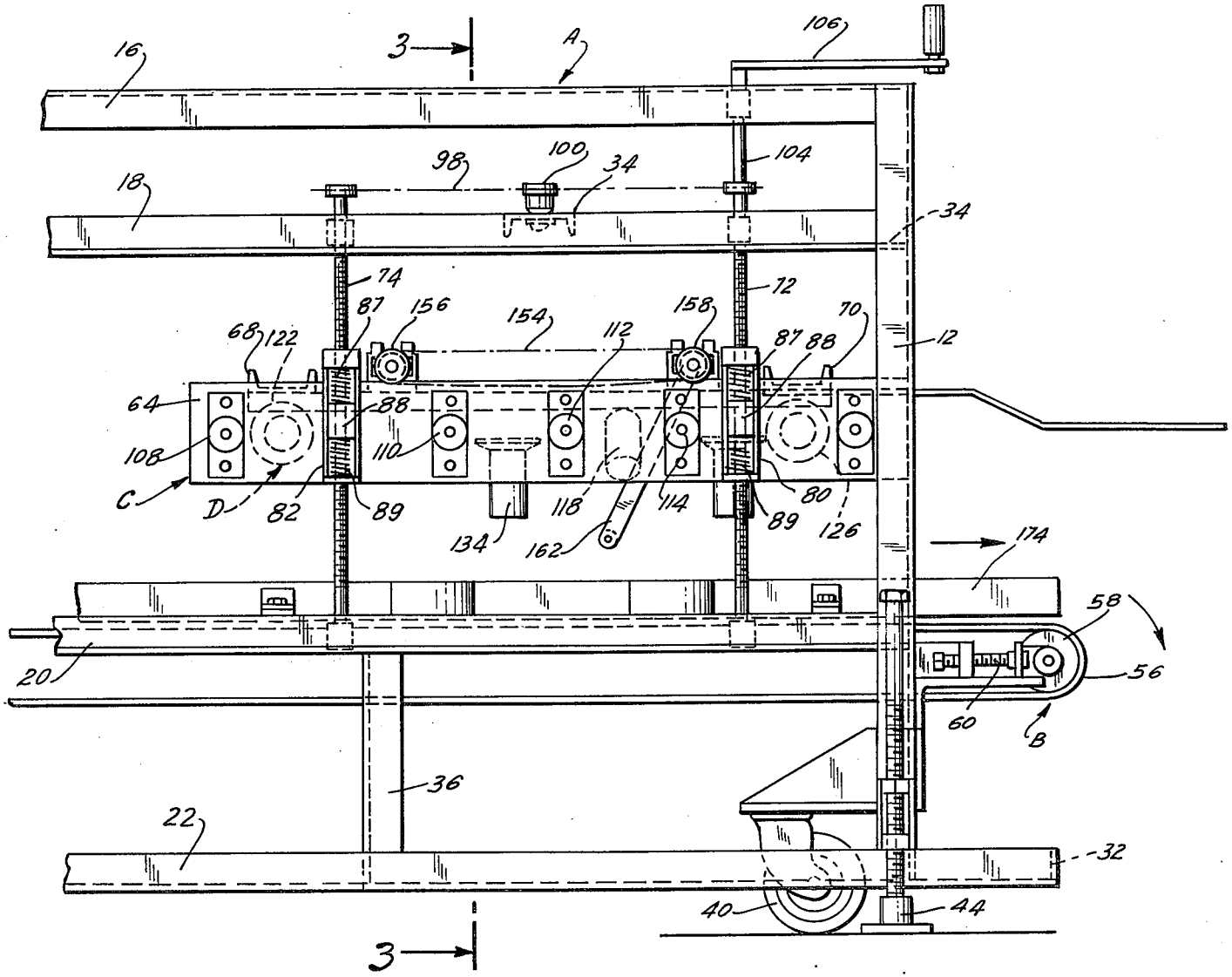
FIG. 1 is a side elevation view of the flap setter of the present invention associated with a carton conveyor.
Figure 2:
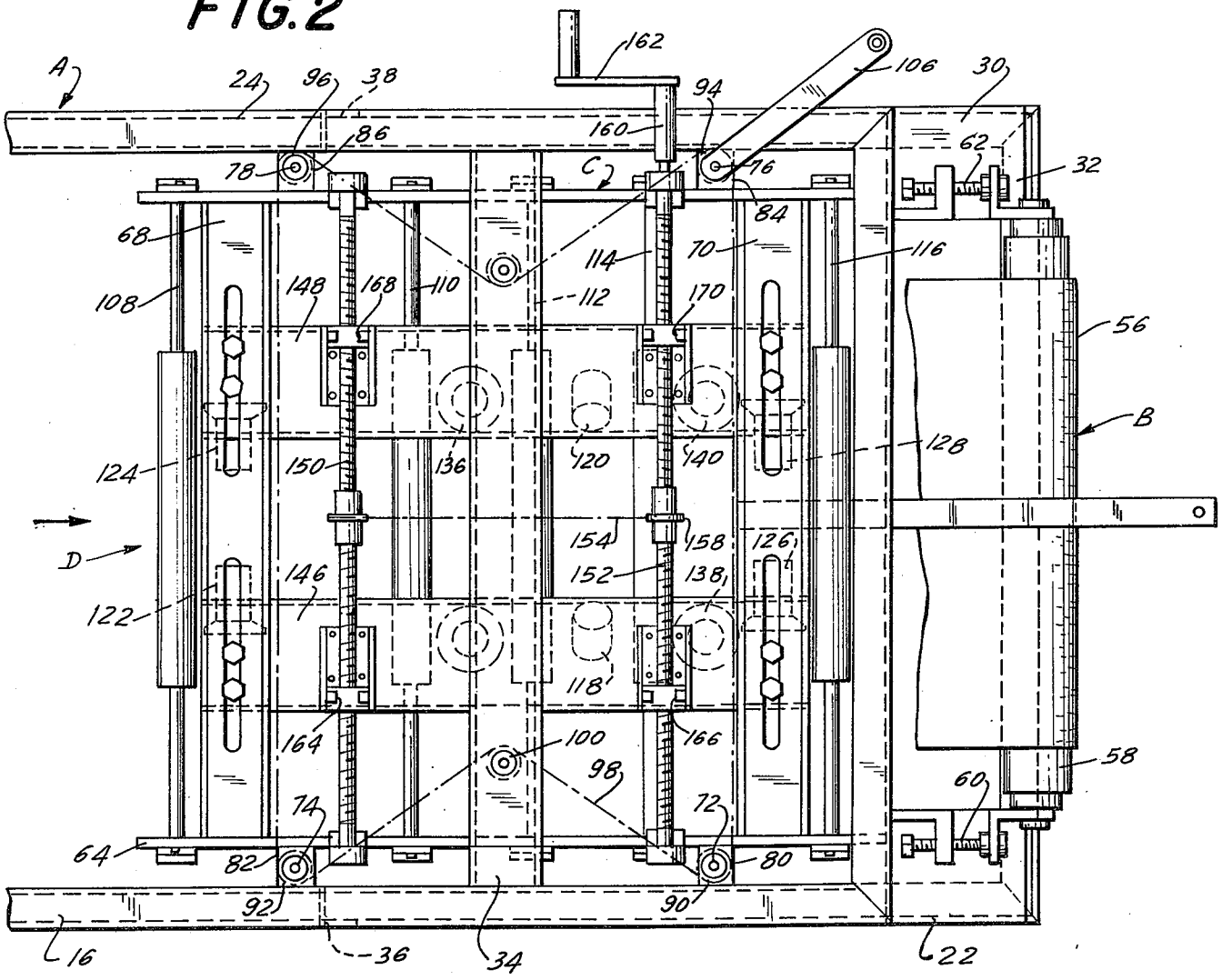
FIG. 2 is a top plan view of the flap setter of the present invention.
Figure 3:
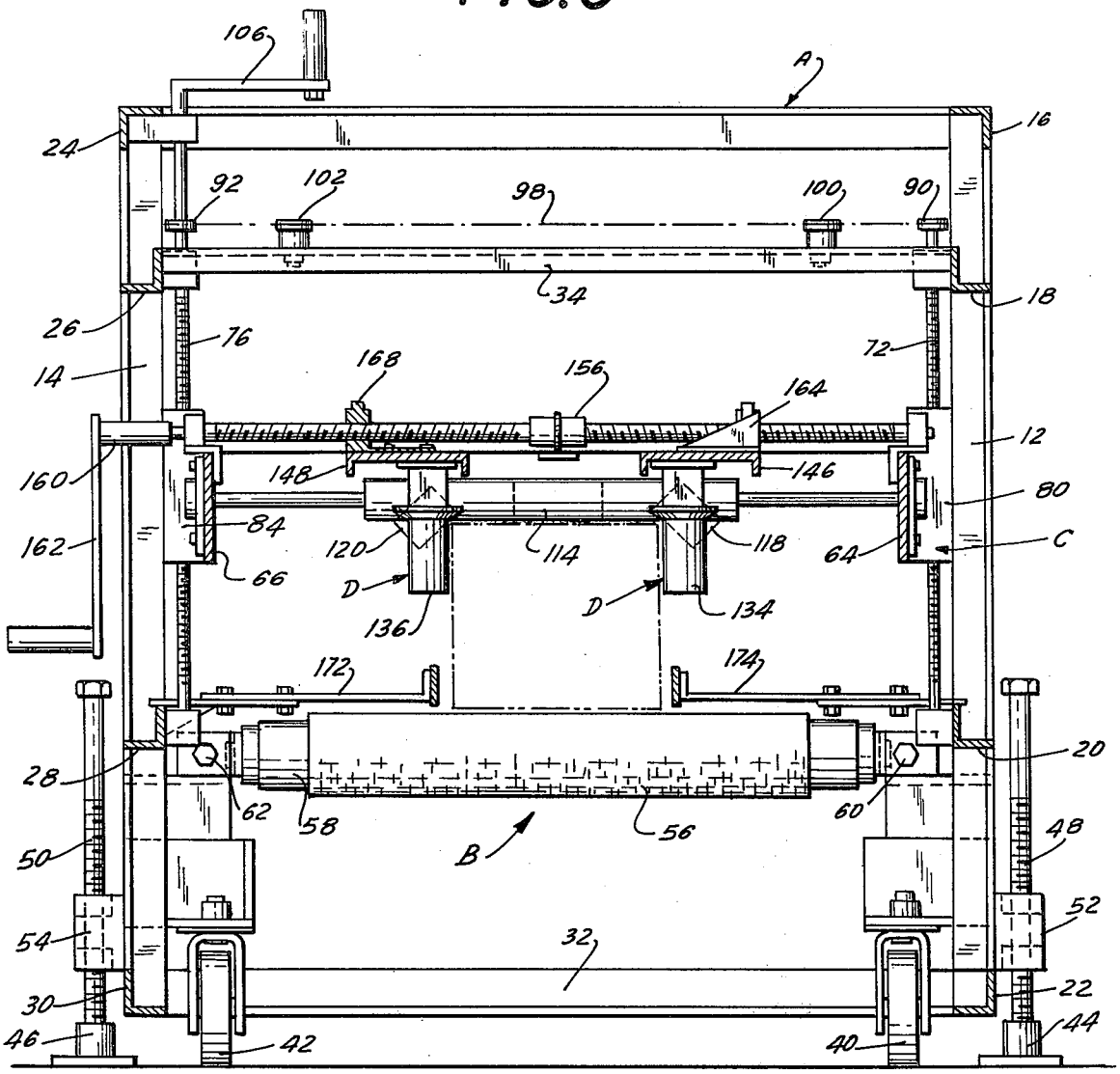
FIG. 3 is a front elevation view of the flap setter of the present invention taken along line 3—3 of FIG. 2.

As seen in FIGS. 1, 2 and 3, the flap setter of the present invention comprises a frame, generally designated A, only a portion of which is shown. The unshown portion (which would appear to the left of the drawings as seen in FIGS. 1 and 2) may comprise the previous station of a carton handling apparatus, for instance, a flap closing station. However, since this station forms no portion of the present invention, it is not illustrated herein.

Frame A is designed for association with a conveyor, generally designated B, which may be a portion of a pre-existing conveyor system on an automated carton handling line. For this reason, as described in detail below, frame A is mounted on rollers or wheels which facilitate positioning thereof with respect to the conveyor system. A support, generally designated C, adjustably mounted on the frame A, is spaced from conveyor B a distance large enough to permit a carton to pass therebetween. Support C has mounted thereon a plurality of rollers, generally designated D, which engage the carton as the carton is moved by conveyor B and exert forces on the crease line and portions of the carton adjacent the crease line to work or manipulate the crease such that the flap will remain in the closed position.

The portion of the frame A shown comprises a pair of spaced vertical members 12, 14 situated at one end of the flap setter (towards the right as shown in FIGS. 1 and 3) to which laterally extending horizontal members 16, 18, 20, 22, and 24, 26, 28, 30 are connected, respectively. Horizontal members 22 and 30 are connected across the front of the machine (as shown towards the right in FIG. 2) by a transverse member 32 and in a similar manner, horizontal members 18 and 26 are connected by a transverse member 34.

Although not shown, it should be understood that additional vertical members, to which the various horizontal members are connected, are provided to support the apparatus. These additional vertical members may form a portion of the previous station, not shown. In addition, vertical members 36, 38 connecting horizontal members 20, 22 and 28, 30, respectively, are provided for additional support.

The entire frame assembly is mounted on wheels, only two of which (40 and 42) are illustrated, to facilitate positioning of the apparatus. Frame A is thus made mobile in order to make the entire apparatus movable and thus facilitate association between the flap setter and pre-existing conveyor systems. The apparatus can thus be moved with respect to the remainder of the normally fixed automated line and positioned in the plant of the user when and where it is needed. This adds considerably to the versatility of the apparatus by permitting the utilization of the flap setter at different parts of the plant at different times with relatively small set-up time.

When the apparatus is positioned appropriately, for example, with respect to the next stage of the carton handling apparatus, legs 44 and 46, (only two of which are shown) may be adjusted to form a brake to prevent any further movement thereof. Legs 44 and 46 are connected to frame A by means of externally threaded rotatable bolts 48, 50 respectively, which, in conjuction with internally threaded blocks 52, 54, respectively, each of which is connected to a different one of the vertical frame members 12, 14, respectively, permit the adjustment of the vertical position of legs 44 and 46 by the rotation thereof. Legs 44 and 46 are adjusted until considerable force is exerted by the bottoms thereof on the surface upon which the apparatus rests thereby preventing the movement of the apparatus. Frame A is associated with conveyor belt B which may be a portion of a pre-existing conveyor system or a separate conveyor which may be used in conjunction with a pre-existing system. Belt B moves the carton relative to the frame A (from the left to the right as shown in FIGS. 1 and 2). Conveyor B may be of any conventional design and is shown herein as an endless belt 56 which travels around an end roller 58 which, in turn, is adjustably mounted by means of adjustment screws 60, 62 to provide the desired belt tension.

The rollers D which are utilized to exert forces on various portions on the carton, as the carton is moved with respect to the frame by conveyor belt 56, are mounted between a pair of upstanding members 64, 66 spaced from the transport surface of conveyor 56. Members 64 and 66 are connected to each other by a pair of transverse members 68, 70. The entire support C, comprised of upstanding members 64, 66 and transverse members 68 and 70 is vertically movable with respect to the remainder of the frame such that the distance between the support and the conveyor belt may be adjusted to accomodate cartons of different heights.

In order to provide vertical adjustability of the support C with respect to conveyor B, four upstanding externally threaded rods 72, 74, 76, 78 are rotatably mounted between the horizontal members. Specifically, rods 71 and 74 are mounted between members 18 and 20 and rods 76 and 78 are mounted between members 26 and 28. Each of the rods 72, 74, 76, 78 passes through a box-like structure 80, 82, 84 and 86, respectively, each of which is fixedly mounted to the support. Specifically, box-like structures 80, 82 are connected to upstanding member 64, whereas box-like structures 84, 86 are connected to upstanding member 66.

Each of the box-like structures 80, 82, 84, 86 has a portion 88 which is slidably mounted within the structure but which is formed so as rotation thereof is prevented. Each portion 88 is mounted between springs 87 and 89 within each structure such that the support is spring mounted to the frame. This assures that the rollers will exert the appropriate forces on the carton as the carton is moved and in addition permits cartons with small variations in the height thereof to pass through the machine without difficulty. Portions 88 are internally threaded and the respective rods extend therethrough. Thus, as the rods are rotated, the meshing of the threads thereon with the internal threads of portions 88 causes the support to move vertically relative to the remainder of the frame.

Rods 72 and 74 extend vertically above horizontal member 18. In a similar manner, rods 76 and 78 extend vertically above horizontal member 26. Each of the rods 72, 74, 76, 78 is provided with a sprocket wheel 90, 92, 94 and 96, respectively, all of which are interconnected by a single chain 98. Chain 98 also passes around sprocket wheels 100 and 101 mounted on transverse member 34. Since chain 98 contacts each of the sprocket wheels attached to the respective rods, all of the rods will rotate simultaneously thus causing the roller support to maintain its relative horizontal position as it is moved vertically with respect to the frame.

Rod 76 is provided with an extension 104 which extends over frame member 16 and is connected, at the end thereof, to a crank 106. The movement of crank 106 moves chain 98 thereby simultaneously rotating each of the rods 72, 74, 76 and 78 to move the support vertically with respect to the frame.

Figure 4:
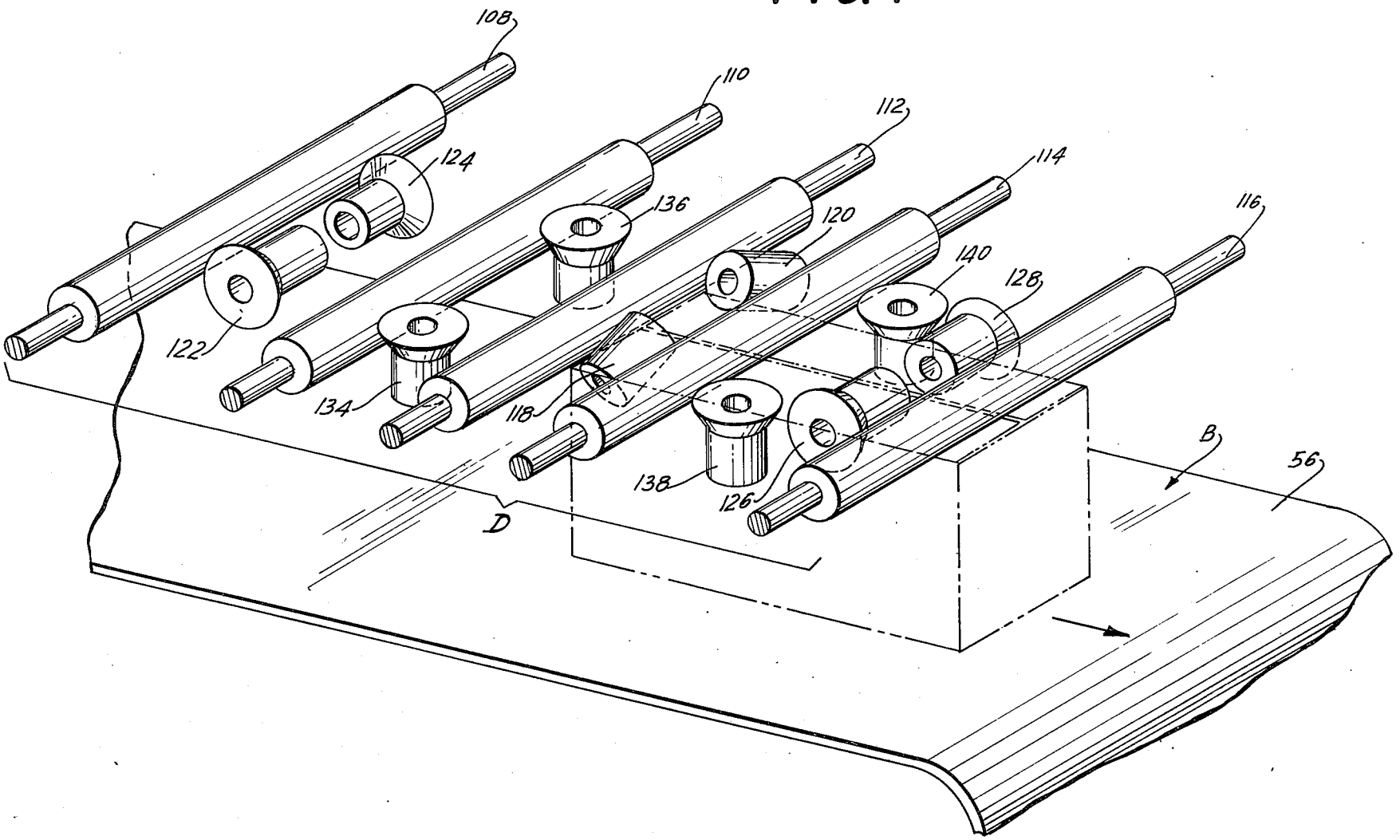
FIG. 4 is an isometric view showing the relative orientations of the rollers in the present invention.

As shown in FIG. 4, the apparatus comprises a number of rollers D of different types. Rollers 108, 110, 112, 114 and 116 are each rotatably mounted between upstanding members 64 and 66 in series along the length of the support C. Each of these rollers exerts a uniform force across the entire top of the carton as the carton is moved by conveyor belt 56. The operative surface of each of these rollers is formed to be long enough to accommodate all of the various different widths of cartons which can be processed by the apparatus.

Figure 7:
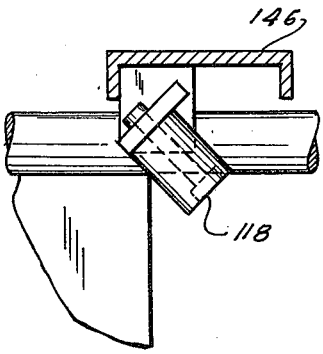
FIG. 7 is a front view of a force exerting roller.

Cylindrical rollers 118 and 120 are mounted on support C such that the surface thereof is oriented at an angle of approximately 45° with the top of the carton. Because of this orientation, the surface of the rollers contacts the carton only directly at the crease line, as shown in FIG. 7.

Figure 5:
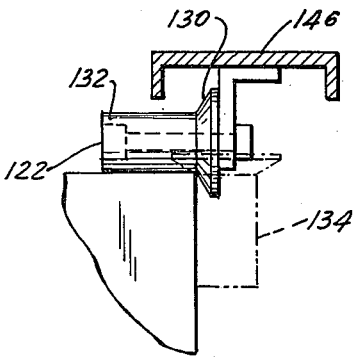
FIG. 5 is a front view of a combined force exerting and deformation preventing roller oriented horizontally.

Two sets of horizontally oriented rollers 122, 124 and 126, 128 are also provided. A typical roller from this group (roller 122) is shown in FIG. 5. Each of the rollers 122, 124, 126 and 128 has a flanged portion 130 and a cylindrical portion 132. The flanged portion 130 has a surface thereof oriented approximately 45° to the top of the carton. Thus, this surface is substantially parallel to the surface of roller 118 or roller 120 and performs basically the same function as these rollers, namely, to act directly on the crease, work or manipulate same as the carton is moved. Cylindrical portion 132 has its operative surface oriented parallel to the surface of the carton adjacent thereto, in this case, the top of the carton. The cylindrical portion 132 of the roller acts as a menas for preventing the buckling or deformation of the carton surface in the area of the crease line. The purpose of cylindrical portion 132 is to assure that the force exerted on the crease line by flange portion 130 does not deform the carton but instead is utilized only to work or manipulate the crease.

Figure 6:
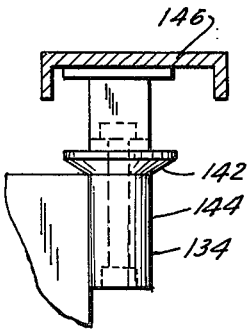
FIG. 6 is a front view of a roller similar to that shown in FIG. 5 but oriented vertically.

Two other sets of rollers 134, 136 and 138, 140 are also provided. These rollers are structurally similar to rollers 122, 124, 126, 128 but are oriented perpendicular thereto and thus in a vertical direction. As shown in FIG. 6, roller 134 has a flanged portion 142 and a cylindrical portion 144. Flange portion 142 makes an angle of approximately 45° with the top of the carton whereas the surface of cylindrical portion 144 is parallel to the portion of the carton adjacent thereto, in this case, the side of the carton. Cylindrical portion 144 acts as deformation preventing means such that the force exerted on the crease by flange portion 142 is utilized only to manipulate or work the crease and not to defrom the carton side.

Rollers D (except for rollers 108, 110, 112, 114, 116 which are mounted between members 64 and 66) are divided into two sets, one set on one side of the center line of the carton and the other set on the other side of the center line of the carton. These sets are movable toward and away from each other such that the apparatus can be adjusted to accommodate cartons of different widths. The position of each of the sets is readily adjustable to reduce changeover time and add versatility to the apparatus.

To that end, as best seen in FIGS. 2 and 3, rollers 122, 134, 118, 138 and 126 are all mounted on a member 146 which extends in the direction of conveyor belt movement. In a similar manner, rollers 124, 136, 120, 140 and 128 are all mounted on a member 148 which extends parallel to member 146. Each of the members 146, 148 are spaced apart and slidably mounted to transverse member 68 at one end thereof and member 70 at the other end thereof.

A pair of threaded rods 150 and 152 are rotatably mounted between upstanding members 64 and 66 and are interconnected by means of a chain 154 which cooperates with sprocket wheels 156 and 158 fixedly mounted on rods 150 and 152, respectively. This interconnection assures that the threaded rods 150 and 152 will rotate simultaneously. Rod 152 has an extended portion 160 to which a crank 162 is mounted such that the rotation of crank 162 causes the rotation of rod 150 and 152 simultaneously.

Element 146 is provided with a pair of brackets 164, 166 with internally threaded portions meshing with the external threads of rods 150 and 152, respectively. In a similar manner, element 148 is provided with brackets 168 and 170, each having internally threaded portions meshing with the external threads of rods 150 and 152, respectively.

Rods 150 and 152 are divided into first and second halves. The threads on each half of a particular rod are pitched in a different direction. Thus, as shown in FIG. 2, when rod 150 is rotated, members 146 and 148 will either move simultaneously towards sprocket wheel 156 or away from sprocket wheel 156, depending upon the direction of rotation of the rod. In a similar manner, the rotation of rod 152 will cause element 146 and element 148 to move simultaneously towards or away from sprocket 158, depending on the direction of rotation of the rod. In this manner, the rotation of crank 162 causes rods 150 and 152 to rotate simultaneously thereby causing members 146 and 148 to move toward or away from each other, depending on the direction of rotation of the crank 162. Members 146 and 148 are, however, always maintained parallel to each other. This movement permits the apparatus to accommodate cartons of different widths.

More specifically, in order for the rollers 122, 124, 134, 136, 138, 140, 126, 128 to function both to exert a force on the crease line and to prevent deformation of the carton adjacent the point on the crease line upon which the force is exerted, it is necessary that the crease line, and therefore the corner of the carton, contact these rollers at the junction between the cylindrical portion and the flange portion thereof. In order to assure that such contact can be achieved, regardless of the width of the carton, the horizontal distance between sets of rollers on each side of the carton is made adjustable. Therefore, these sets of rollers can be moved toward or away from each other to accommodate cartons of different widths.

A pair of guide rails 172, 174 are mounted to horizontal members 28 and 20, respectively, so as to assist in maintaining the carton in the proper position with respect to conveyor belt 56. Guide rails 172 and 174 are also made adjustable so as to accommodate cartons of different widths.

Upstanding members 64 and 66, upon which the rollers are mounted, may be mounted on frame A in such a manner such that they are slightly inclined downwardly towards the direction of movement of the conveyor such that as the carton moves along the frame, the forces exerted thereon by successive rollers progressively increase. Thus, the crease tends to be worked or manipulated more severely as the carton is moved.

It should be understood that while the present invention has been shown and described as having a small number of different types of rollers, for purposes of illustration, the invention should not be construed to be limited to these particular types of rollers. Other, different size or shape rollers may be utilized in addition to or instead of the rollers shown. Moreover, the rollers may appear in different sequences or in different locations with respect to the carton.

The present invention is an apparatus for setting the flaps of a carton in a given postion, such as the closed position. Both the height of the rollers and the distance between opposite sets thereof are adjustable such that different size cartons can be accommodated. The rollers are utilized to manipulate the crease line between the flap and the carton such as to work the crease thereby preventing the flap from opening subsequently. At the same time, portions of certain of the rollers prevent the deformation of the carton surfaces adjacent the crease line thereby assuring that all the force exerted on the crease line is utilized in manipulating or working the crease line and not in deforming the carton. In addition, the support upon which rollers are mounted may be inclined slightly downwardly in the direction of carton movement such that successive pairs of rollers exert progressively increasing forces on the carton thereby causing greater and greater manipulation or working of the crease line as the carton moves relative to the frame.

Because of the shape of the frame and the mobility thereof, the apparatus of the present invention may be readily associated with pre-existing conveyor systems. Thus, when used in this manner, the apparatus does not require any additional floor space and does not interfere with the automated carton handling line. This adds substantially to the versatility of the apparatus by permitting the apparatus to be used in different portions of a plant at different times with minimal set-up time.

While but a single embodiment of the present invention has been disclosed herein for purposes of illustration, it is obvious that many variations and modifications may be made thereto. It is intended to cover all of these variations and modifications that fall within the scope of this invention as defined by the appended claims.

What is claimed is:

1. Apparatus for setting an unsealed container flap formed along a crease line in a given position relative to the container without sealing the same thereto, said apparatus comprising a frame, a crease working and setting station on said frame, means for moving said container along a path relative to said frame through said station, said container being erected and having an appreciable internal cross-section at right angles to said path, the space traversed by said container cross-section being free of parts mounted on said frame so that said erected container passes unimpededly therethrough, and means mounted on said frame at said station and workingly active on said crease line as said container moves therepast, said workingly active means comprising first means engageable with said flap and effective to hold said flap substantially in said given position as said container passes through said station, and second means directely engageable with and active on said crease line to work the same while said flap is held in said given position, said second means comprising a plurality of pressure members having crease-line-engaging surfaces oriented at an angle other than a right angle with respect to both said flap when in said given position and the container wall to which said flap is attached and effective to directly engage said crease line and to exert a working force directly thereon as the container is thus moved, said pressure members being capable of operating effectively on said crease line in the absence of any additional structure for engaging or supporting said crease line in the absence of any additional structure for engaging or supporting said crease line in opposition to the force exerted by said pressure members, said plurality of pressure members being spaced from one another along said station and being sequentially and progressively active on said crease line to work the same, whereby a given section of said crease line is worked by being pressed and released a plurality of times as said container passes through said station.

2. The apparatus of claim 1 wherein at least some of said pressure members comprise means engageable with the exterior of said container for preventing deformation of the container surface adjacent said crease line.

3. The apparatus of claim 2 wherein said deformation preventing means acts on a portion of the container surface adjacent that point on said crease line upon which said pressure member acts.

4. The apparatus of claim 2 wherein said deformation preventing means comprises a roller having a surface substantially parallel to the container surface adjacent thereto.

5. The apparatus of claim 2 wherein at least one of said pressure members comprises a roller having a flanged portion defining said crease-line-engaging surface and a cylindrical portion defining said deformation-prevention means.

6. The apparatus of claim 5 wherein said crease-line-engaging surface of said one of said pressure members is oriented approximately 45° from the top surface of the container and wherein said cylindrical portion has a surface substantially parallel to the container surface adjacent thereto.

7. The apparatus of claim 5 wherein said roller is rotatably mounted on said frame.

8. The apparatus of claim 1 wherein said pressure members are adjustably mounted on said frame.

9. The apparatus of claim 1 further comprising spring means for mounting said pressure members on said frame.

10. The apparatus of claim 5 wherein another of said pressure members comprises a second roller having a flanged portion defining said crease-line-engaging surface and a cylindrical portion defining said deformation prevention means, said second roller being oriented in a substantially perpendicular direction relative to said first mentioned roller.

11. The apparatus of claim 5 wherein said roller is positioned to engage the container such that said crease line contacts the junction between said flanged portion and said cylindrical portion.

12. The apparatus of claim 1 wherein one of said progressively active members is positioned closer to said crease line than another of said pressure members.

* * * * *